US006289186B1

(12) United States Patent
Ohshima

(10) Patent No.: US 6,289,186 B1
(45) Date of Patent: Sep. 11, 2001

(54) IMAGE FORMING APPARATUS

(75) Inventor: Shinji Ohshima, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/489,018

(22) Filed: Jan. 21, 2000

(30) Foreign Application Priority Data

Jul. 6, 1999 (JP) ..... 11-191265

(51) Int. Cl.[7] ..... G03G 15/00
(52) U.S. Cl. ..... 399/75; 399/66; 399/297
(58) Field of Search ..... 399/303, 312, 399/75, 66, 76, 77, 297

(56) References Cited

U.S. PATENT DOCUMENTS 5,386,274 * 1/1995 Sanpe et al. .
5,631,725 * 5/1997 Harasawa et al. ..... 399/66
5,812,919 * 9/1998 Takano et al. ..... 399/312
5,923,936 * 7/1999 Tanoue et al. ..... 399/297
5,930,573 * 7/1999 Miyamoto et al. ..... 399/310

FOREIGN PATENT DOCUMENTS 5-119635 5/1993 (JP) .
6-186894 7/1994 (JP) .

* cited by examiner

*Primary Examiner*—William J. Royer
(74) *Attorney, Agent, or Firm*—Armstrong, Westerman, Hattori, McLeland & Naughton

(57) ABSTRACT

Upon restarting a printer, current is fed to a charge roller for charging a transfer belt, a drum charger for charging a photosensitive drum and a developing unit for developing a latent image on the photosensitive drum, while prohibiting current feed to an LED head. Then, the transfer belt is caused to abut upon the photosensitive drum, driven in a given direction and cleaned at a downstream side by a belt cleaner.

7 Claims, 7 Drawing Sheets

IMAGE FORMING APPARATUS

BACKGROUND OF THE INVENTION

1. Field of the Invention

The present invention relates to an image forming apparatus using an electrophotography technique, such as a copying machine, a facsimile machine or a printer, which forms a toner image on an image holder such as a photosensitive drum and transfers the toner image onto a recording medium, by means of electrostatic attraction.

2. Description of the Related Art

In an image forming apparatus which forms a toner image on an image holder such as a photosensitive drum and transfers the toner image onto a recording medium such as paper, when the apparatus is stopped due to a paper jam or the like, nonfixed toner remains on a photosensitive drum 1 as shown in FIG. 7. In FIG. 7, numeral 2 denotes a transfer belt and numeral 6 a charge roller for charging the transfer belt 2. Since the photosensitive drum 1 can not stop its rotation immediately upon stoppage of the apparatus due to its inertia, a remaining range of the nonfixed toner becomes correspondingly large. Thus, when restarting the apparatus, the nonfixed toner on the photosensitive drum 1 is separated and recovered by means of a cleaner at a downstream side relative to the rotation of the photosensitive drum 1.

However, if such a cleaning operation is performed every time the apparatus is restarted, a large load is applied to a blade of the cleaner so that a stable cleaning effect can not be ensured.

In view of this, Japanese Laid-open (unexamined) Patent Publication No. 5-119635 proposes a technique wherein, as shown in FIG. 8, when an image forming apparatus is restarted, a transfer belt 2 is caused to abut upon a photosensitive drum 1 and current (although there is no particular explanation in the foregoing publication, it is considered from a context that a value of the current is approximately equal to a value of transfer current which is supplied upon image formation on a recording medium) is fed to a transfer charger such as a charge roller 6 for giving charge to the transfer belt 2. Thus, the foregoing nonfixed toner on the photosensitive drum 1 is transferred onto the transfer belt 2 and then removed by a cleaner of the transfer belt 2 at a downstream side thereof, while residual toner on the photosensitive drum 1 after the transfer is recovered by a cleaner of the photosensitive drum 1. Thus, a load applied to the cleaner of the photosensitive drum 1 is reduced. The residual toner recovered by the cleaner of the photosensitive drum 1 is subjected to removal of charge and then returned to a developing unit so as to be recycled for developing a latent image on the photosensitive drum 1.

However, in the image forming apparatus wherein toner at the developing unit is always in contact with the photosensitive drum, the toner flows out onto the photosensitive drum due to the rotation of the photosensitive drum upon restarting the apparatus even if charge is not applied to the developing unit. The technique of the foregoing publication can not prevent such flowing-out of the toner upon restarting the apparatus.

Further, when the restart of the apparatus due to a paper jam is carried out, paper powder invades the nonfixed toner on the photosensitive drum. The nonfixed toner mixed with the paper powder is separated from the photosensitive drum by the cleaner of the photosensitive drum. However, the nonfixed toner mixed with the paper powder significantly increases abrasion of a blade of the cleaner, thereby to cause replacement thereof and shorten the life duration of the photosensitive drum.

Further, if the toner returned from the cleaner of the photosensitive drum to the developing unit for recycling contains the paper powder, charging of the toner is adversely affected to induce an adverse effect on the print quality.

SUMMARY OF THE INVENTION

Therefore, it is an object of the present invention to provide an improved image forming apparatus.

According to one aspect of the present invention, there is provided an image forming apparatus characterized by, upon restarting the image forming apparatus, feeding current to all elements each having a charge feeding function, the elements including a transfer charger for charging a transfer member, causing the transfer member to abut upon an image holder, driving the transfer member in a given direction, and cleaning the transfer member at a downstream side of a contact portion between the transfer member and the image holder in the given direction.

FIG. 1 is a diagram for explaining a concept of the present invention. In the figure, upon restarting the image forming apparatus, the current is fed to a transfer charger 6*a* which charges a transfer member 2*a*, as well as an image holder charger 8*a* and a developing unit 9*a* each having a charge feeding function. Nonfixed toner remains on the surface of an image holder 1*a*. In the FIG., 3*a* denotes a transfer member cleaner, 7*a* a latent image forming unit, 100*a* an image holder cleaner, and 102*a* a return path for returning toner recovered by the image holder cleaner 100*a* to the developing unit 9*a*.

The image holder charger 8*a* charges the image holder 1*a* in minus or plus, while the developing unit 9*a* also charges toner in minus or plus. If there is caused no potential difference between the charged image holder 1*a* and the charged toner, repulsion occurs therebetween so that the toner is prevented from flowing out onto the image holder 1*a* due to the rotation of the image holder la. Thus, since the nonfixed toner on the image holder 1*a* is transferred onto the transfer member 2*a* and cleaned by the transfer member cleaner 3*a* and since the flowing-out of the toner onto the image holder 1*a* is prevented, a toner removal load of the image holder cleaner 100*a* can be reduced. For realizing an equipotential state between the charged image holder 1*a* and the charged toner, the latent image forming unit 7*a* should be prohibited from forming a latent image on the image holder 1*a*.

According to another aspect of the present invention, there is provided an image forming apparatus comprising an image holder on which an image is formed; a transfer member for conveying a recording medium, the transfer member caused to abut upon the image holder so as to transfer the image formed on the image holder onto the recording medium; a transfer charger for charging the transfer member; a cleaner for cleaning the transfer member at a downstream side of a contact portion between the transfer member and the image holder in a driven direction of the transfer member; a detecting means for detecting restart of the image forming apparatus; and a control means for executing a current feed control, wherein, when the detecting means detects the restart of the image forming apparatus, the control means feeds current to all elements each having a charge feeding function, the elements including the transfer charger, causes the transfer member to abut upon the image holder, and drives the transfer member in a given direction, and the cleaner cleans the transfer member at a downstream side of a contact portion between the transfer member and the image holder in the given direction.

Since the restart of the image forming apparatus requires an initialize process which is normally executed upon turning on a power switch of the apparatus, the detecting means detects an initialize signal as a signal indicative of the restart of the apparatus. The detecting means may be realized by a control box which will be described later.

The elements to be fed with the current by the control means include the transfer charger, an image holder charger and a developing unit. The transfer charger charges the transfer member for transferring nonfixed toner on the image holder onto the transfer member. The image holder charger charges the image holder in minus or plus, while the developing unit also charges toner in minus or plus. If there is caused no potential difference between the charged image holder and the charged toner, repulsion occurs therebetween so that the toner is prevented from flowing out onto the image holder due to the rotation of the image holder.

The control means executes the current feed control so as not to cause a potential difference between the image holder and the toner and may be realized by the control box which will be described later.

According to another aspect of the present invention, there is provided an image forming apparatus characterized by, upon restarting the image forming apparatus, applying charge higher than charge required upon image formation to a transfer member, feeding current to an image holder charger for charging an image holder and a developing unit for developing a latent image on the image holder while prohibiting a latent image forming unit from forming a latent image on the image holder, causing the transfer member to abut upon the image holder, driving the transfer member in a given direction, and cleaning the transfer member at a downstream side of a contact portion between the transfer member and the image holder in the given direction.

This aspect of the present invention provides a technique which is effective for removing toner mixed with paper powder from the image holder. Since the paper powder is liable to be charged, the toner mixed with the paper powder firmly adheres to the image holder. Thus, by applying charge higher than charge required upon image formation to the transfer member, the toner mixed with the paper powder can be effectively removed from the image holder.

It may be arranged that when applying the charge to the transfer member, current of 450 $\mu$A or greater is fed to a transfer charger which charges the transfer member. This enables the transfer member to be applied with the charge higher than the charge required upon the image formation.

BRIEF DESCRIPTION OF THE DRAWINGS

The present invention will be understood more fully from the detailed description given hereinbelow, taken in conjunction with the accompanying drawings.

In the drawings:

FIG. 7 is an explanatory diagram showing a state wherein nonfixed toner remains on a photosensitive drum in a conventional image forming apparatus when the apparatus is stopped due to a paper jam or the like.

DESCRIPTION OF THE PREFERRED EMBODIMENT

Now, a preferred embodiment of the present invention will be described hereinbelow with reference to the accompanying drawings.

Figure 1:
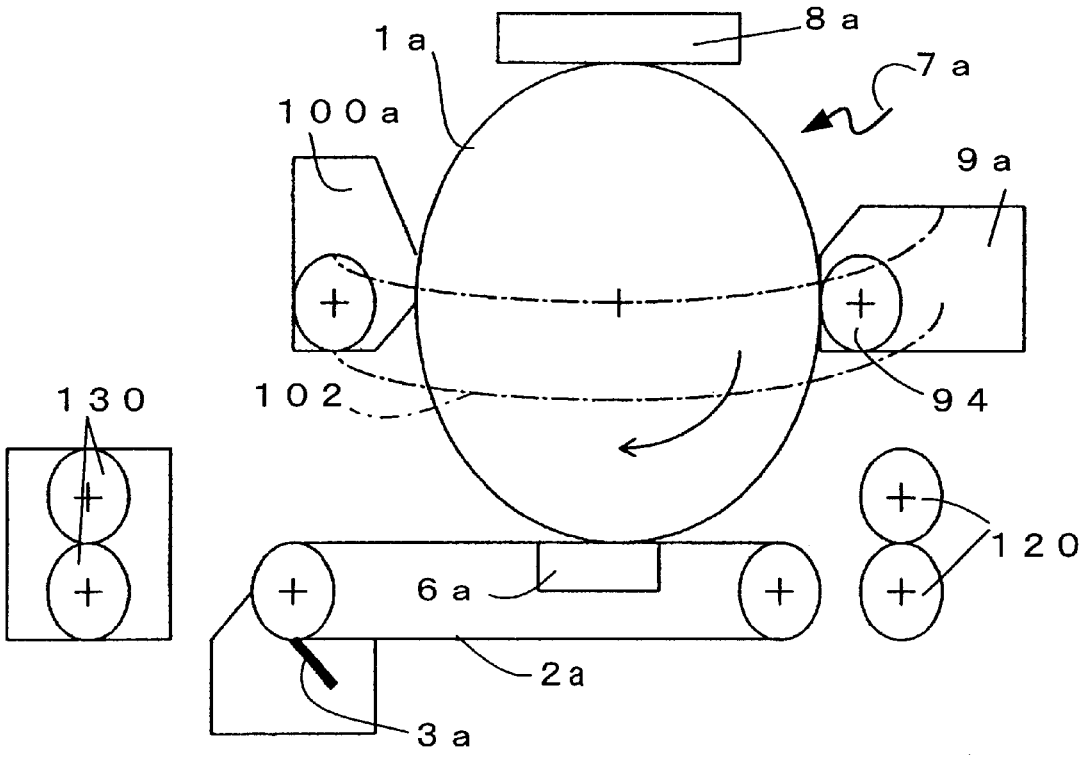
FIG. 1 is a diagram for explaining a concept of the present invention.
Figure 2:
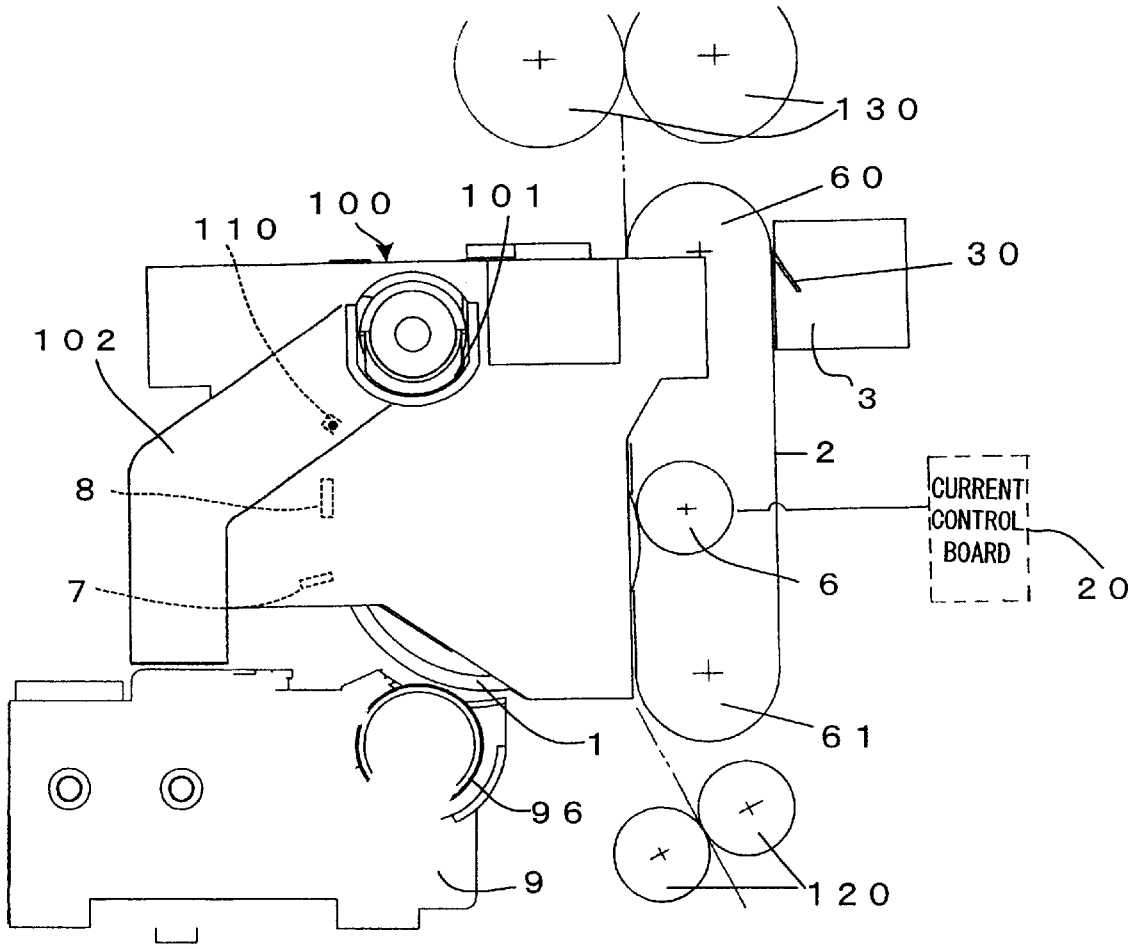
FIG. 2 is a diagram showing a schematic structure of a printer according to a preferred embodiment of the present invention.

FIG. 2 shows a schematic structure of a printer according to the preferred embodiment of the present invention. In the figure, numeral 1 denotes a photosensitive drum serving as an image holder, numeral 2 a transfer belt, numeral 3 a belt cleaner with a blade 30, numeral 6 a charge roller serving as a transfer charger, numeral 7 an LED head serving as a latent image forming unit, numeral 8 a drum charger, numeral 9 a developing unit, numeral 100 a drum cleaner with a blade 101 for performing toner separation, numeral 110 a removal lamp for removing residual charge on the photosensitive drum 1, numeral 120 a pair of resist rollers and numeral 130 a pair of fixing rollers.

Figure 3:
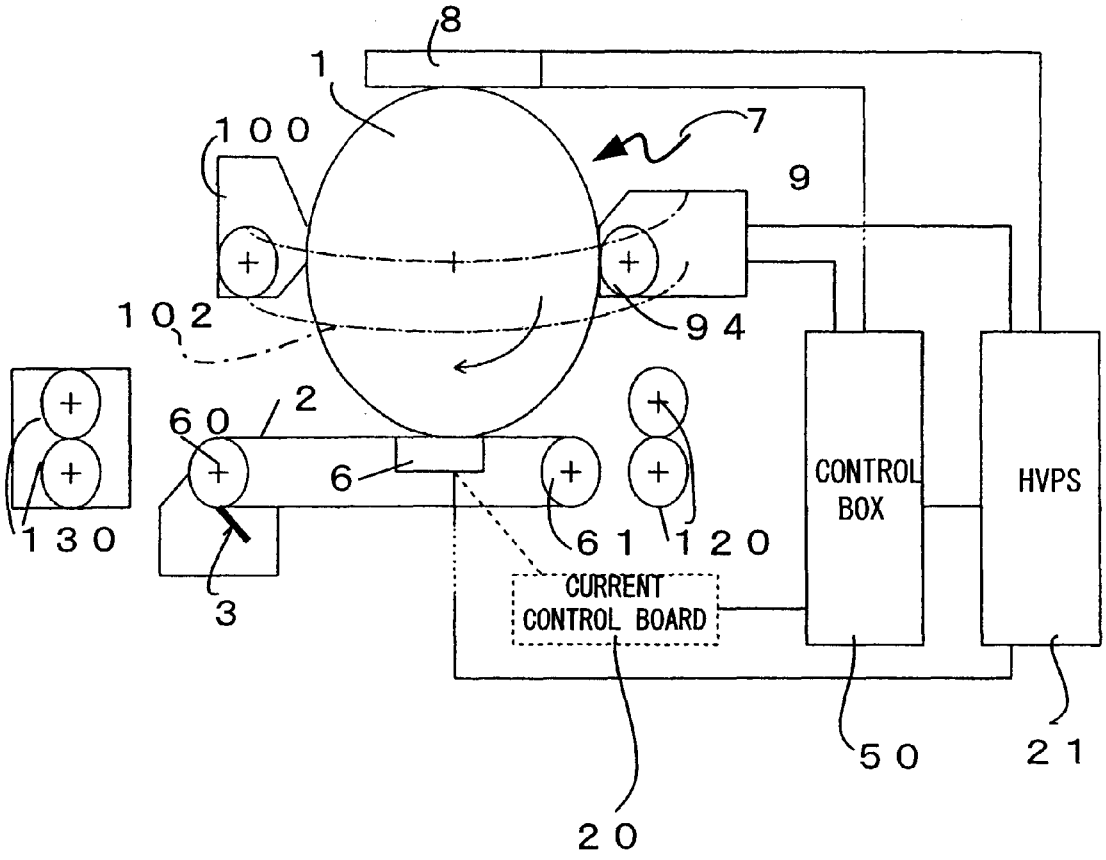
FIG. 3 is a diagram for explaining an operation of the printer.

FIG. 3 is a diagram for explaining an operation of the printer shown in FIG. 2. After the photosensitive drum 1 is charged by the drum charger 8, a latent image is formed thereon by means of the LED head 7. Then, toner is adhered to the latent image on the photosensitive drum 1 by means of a developing roller 94 of the developing unit 9. Then, the toner image on the photosensitive drum 1 is transferred onto paper which is conveyed on the transfer belt 2 and charged by the charge roller 6 via the transfer belt 2. Finally, the toner image is fixed on the paper by means of the fixing rollers 130. On the other hand, a portion of the toner remains on the photosensitive drum 1 after the toner image is transferred onto the paper. The residual toner is separated from the photosensitive drum 1 by means of the blade 101 of the drum cleaner 100, and the photosensitive drum 1 is subjected to removal of charge by means of the removal lamp 110. The residual toner separated by the blade 101 of the drum cleaner 100 is recovered by means of a screw (not shown) in the drum cleaner 100 and returned to the developing unit 9 via a return path 102 for recycling.

Figure 4:
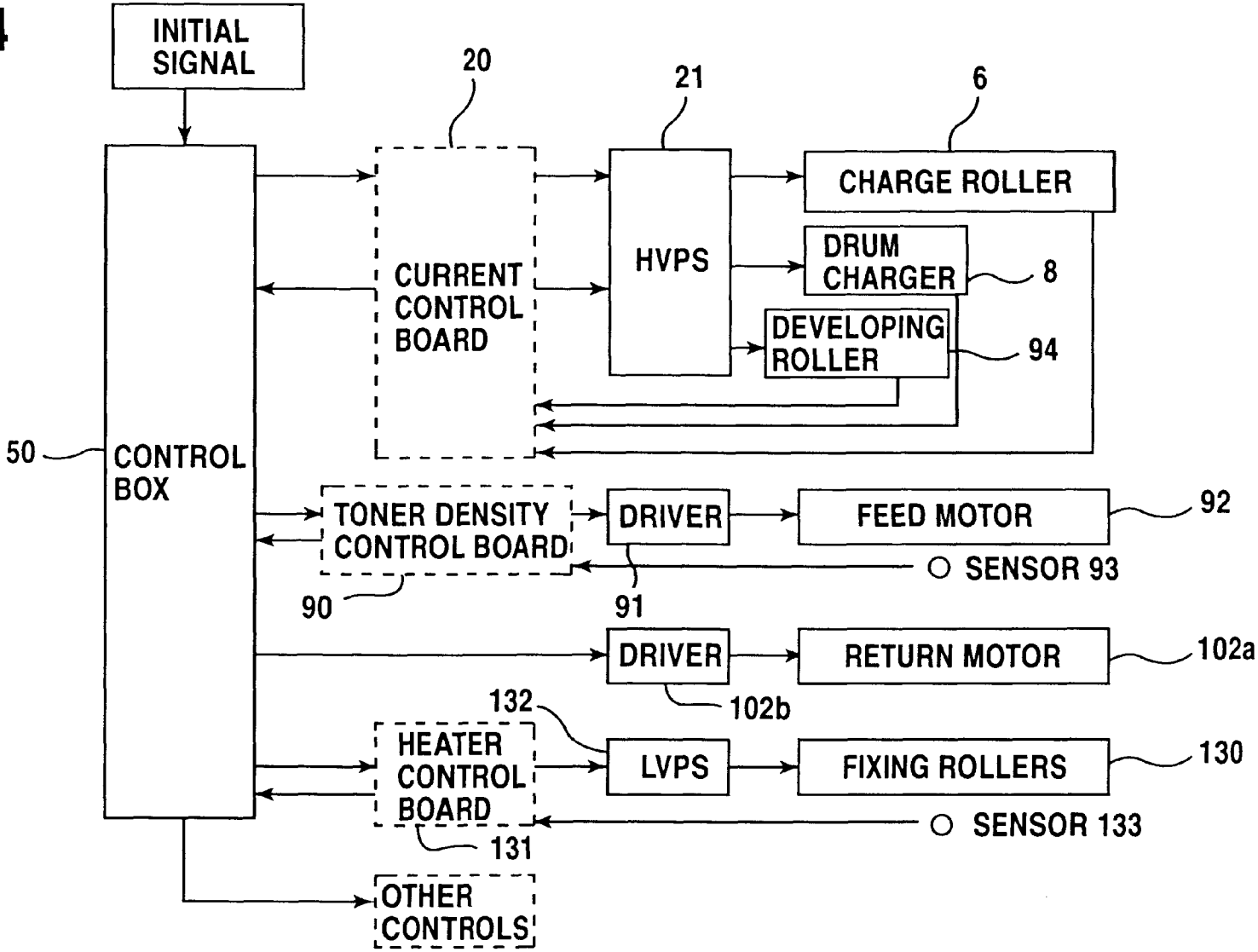
FIG. 4 is a block diagram showing a structure of a power control section of the printer.

FIG. 4 shows a structure of a power control section of the printer. The power control section comprises a control box 50, a current control board 20 controlled by the control box 50 for controlling currents fed to the charge roller 6, the drum charger 8 and the developing roller 94, and a high voltage power supply 21. The power control section further comprises a toner density control board 90 controlled by the control box 50 for adjusting the toner density of the developing unit 9, a driver 91 and a feed motor 92 for feeding toner. The power control section further comprises a return motor 102*a* which is used for the return path 102 for returning toner recovered by the drum cleaner 100, and a driver 102*b* controlled by the control box 50 for controlling an operation of the return motor 102*a*. The power control section further comprises a heater control board 131 controlled by the control box 50 for controlling an operation of a heater of the fixing rollers 130, and a low voltage power supply 132. The control box 50 further controls light emission of the LED head 7 and rotation of the photosensitive drum 1.

A sensor 93 is connected to the toner density control board 90. According to the toner density detected by the sensor 93, the toner density is adjusted by the toner density control board 90. Further, a sensor 133 is connected to the heater control board 131. According to the surface temperature of the fixing rollers 130 detected by the sensor 133, the heater temperature is adjusted by the heater control board 131.

In the printer thus arranged, when the printer is stopped due to an error in the operation thereof, such as a paper jam or the like, nonfixed toner remains on the photosensitive drum 1 as explained before. Thus, upon restarting the printer, the current is fed to the charge roller 6 and the transfer belt 2 is caused to abut upon the photosensitive drum 1 so that the nonfixed toner is transferred onto the transfer belt 2. Then, the transferred toner is conveyed on the transfer belt 2 to a downstream side where the toner is removed from the transfer belt 2 by means of the belt cleaner 3.

Specifically, upon restarting the printer, an initialize signal is inputted into the control box 50. Thus, the control box 50 can detect the restart of the printer. In response to the initialize signal, the control box 50 executes an initial control via the current control board 20 to feed the current to the charge roller 6, cause the transfer belt 2 to abut upon the photosensitive drum 1, drive the transfer belt 2 to run in a given direction corresponding to one rotation of the photosensitive drum 1, and rotate the photosensitive drum 1 to make one rotation. Thus, the nonfixed toner on the photosensitive drum 1 is transferred onto the transfer belt 2 and conveyed to the downstream belt cleaner 3.

Further, in response to the initialize signal, the control box 50 performs current controls for the drum charger 8 and the developing roller 94 via the current control board 20 and further controls light emission of the LED head 7. Specifically, in response to a command from the control box 50, the current control board 20 feeds current to the drum charger 8 to charge the photosensitive drum 1 and further feeds current to the developing roller 94 to charge toner. In this event, if there is no difference in potential between the charged photosensitive drum 1 and the charged toner, repulsion occurs therebetween so that the toner is prevented from flowing out onto the photosensitive drum 1 due to the rotation of the photosensitive drum 1. At this time, if light emission of the LED head 7 is implemented, there is caused a difference in potential between the toner and a latent image formed on the photosensitive drum 1 corresponding to the light emission. Thus, the control box 50 controls the LED head 7 not to produce light emission.

As seen from FIG. 4, a charged state of the transfer belt 2, a charged state of the photosensitive drum 1 and a charged state of the toner corresponding to the currents fed to the charge roller 6, the drum charger 8 and the developing roller 94 are fed back to the control box 50 via the current control board 20, so that the current control board 20 controls the currents supplied thereto to appropriate values.

As described above, according to this embodiment, the nonfixed toner on the photosensitive drum 1 is transferred onto the transfer belt 2 and then removed by the belt cleaner 3. In addition, the control is further performed so as not to generate a difference in potential between the photosensitive drum 1 charged by the drum charger 8 and the toner charged by the developing roller 94 of the developing unit 9, thus resulting in repulsion between the surface of the photosensitive drum 1 and the toner. Therefore, the toner is prevented from flowing out onto the photosensitive drum 1 due to the rotation of the photosensitive drum 1. Thus, a toner removal load of the drum cleaner 100 can be reduced.

Before conceiving the present invention, the inventor conducted an experiment on the conventional structure of the foregoing publication (Japanese Laid-open Patent Publication No. 5-119635). A result of the experiment is that the print quality is gradually lowered, that abrasion of the blade 101 of the drum cleaner 100 is significant so that the number of times of replacement thereof can not be reduced as expected, and that the life duration of the photosensitive drum 1 can not be prolonged as expected due to the abrasion of the cleaner blade.

After thorough studies, it is concluded in view of the lowering of the print quality that impurities are contained in the residual toner recovered by the drum cleaner 100 for recycling. In the course of identifying the impurities, an experiment was further conducted as follows:

In the former experiment, transfer current supplied to the charge roller 6 upon restarting the printer was fixed to a value which is approximate to that of transfer current fed to the charge roller 6 upon printing (upon image formation on a recording medium). By changing a value of current supplied to the charge roller 6, it was found in this experiment that an amount of toner adhesion to the transfer belt 2 changed.

Figure 5:
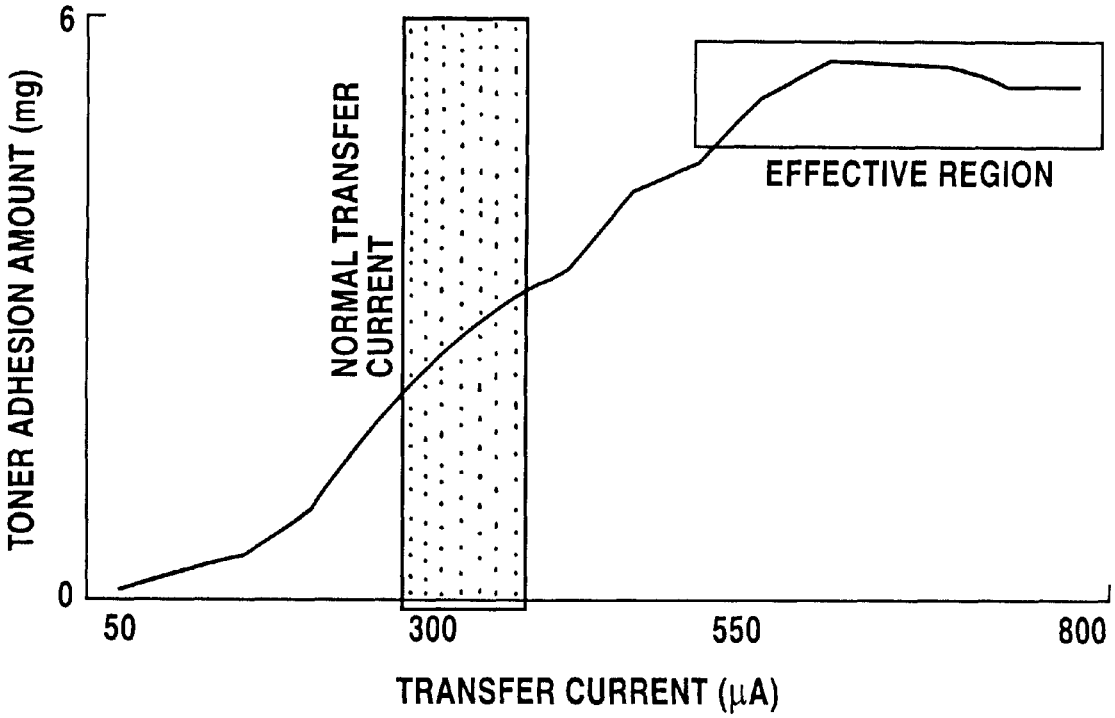
FIG. 5 is a graph showing variation in amount of toner adhesion to a transfer belt when transfer current fed to a charge roller is changed upon restarting the printer.

FIG. 5 and Table 1 show a result of the experiment. In FIG. 5, an X-axis represents values of transfer current supplied to the charge roller 6, while a Y-axis represents toner adhesion amounts on the transfer belt 2 (to be exact, amounts of toner recovered by the belt cleaner 3).

TABLE 1

| TRANSFER CURRENT (μA) | EFFECT |
|---|---|
| 50 | x |
| 100 | x |
| 150 | x |
| 200 | x |
| 250 | x |
| 300 | Δ |
| 350 | Δ |
| 400 | Δ |
| 450 | ⊚ |
| 500 | ⊚ |
| 550 | ⊚ |
| 600 | ⊚ |
| 650 | ⊚ |
| 700 | ⊚ |
| 750 | ⊚ |
| 800 | ⊚ |

Normally, the toner adhesion amount on the photosensitive drum 1 is 20 to 25 mg per piece of A4 paper. On the other hand, the nonfixed toner remaining on the photosensitive drum 1 upon stoppage of the printer due to a paper jam or the like is considered to be 5 to 6 mg corresponding to about a quarter of the circumference of the photosensitive drum 1.

The value of transfer current fed to the charge roller 6 upon printing is about 300 μA. Around this current value, however, only 2 to 3 mg of toner was recovered by the belt cleaner 3. Then, as the current value increased, the toner recovery amount also increased gradually. At the current value of 450 μA, about 5 mg of the toner was recovered so that the toner was almost fully recovered. In this experiment, the transfer current was set up to 800 μA. However, the effect, i.e. the toner recovery amount by the belt cleaner 3, was saturated around the current value of 600 $\mu$A and there was no substantial change thereafter. This is considered to be based on the fact that the toner recovery amounts around those current values are close to 6 mg which is considered to be the maximum value of the nonfixed toner remaining on the photosensitive drum 1.

From the foregoing result, it is assumed that paper powder generated upon restarting the printer invades the nonfixed toner on the photosensitive drum 1 in the conventional structure of the foregoing publication. Specifically, the paper powder is liable to be charged so that the toner mixed with the paper powder firmly adheres to the photosensitive drum 1. It is assumed that when the toner mixed with the paper powder is recovered, it abrades the blade of the drum cleaner 100 thereby to shorten the life duration of the photosensitive drum 1 resultantly. It is further assumed that recycling of the toner mixed with the paper powder at the developing unit 9 gradually lowers the print quality.

Thus, in this embodiment, upon restarting the printer, the transfer belt 2 is applied with charge higher than charge which is applied to the transfer belt 2 upon printing. Specifically, during the foregoing initial control, the control box 50 controls the current control board 20 to feed transfer current of 450 $\mu$A or greater to the charge roller 6 so as to almost fully remove the nonfixed toner mixed with the paper powder from the photosensitive drum 1 as described above. Thus, recycling of the toner mixed with the paper powder, which would be otherwise caused via the drum cleaner 100, can be effectively prevented to ensure the constant print quality for a long time. Further, since the nonfixed toner with the paper powder is almost fully removed from the photosensitive drum 1 by means of the highly-charged transfer belt 2, abrasion of the blade 101 of the drum cleaner 100 due to the toner with the paper powder upon restarting the printer can be effectively prevented.

Figure 6A:
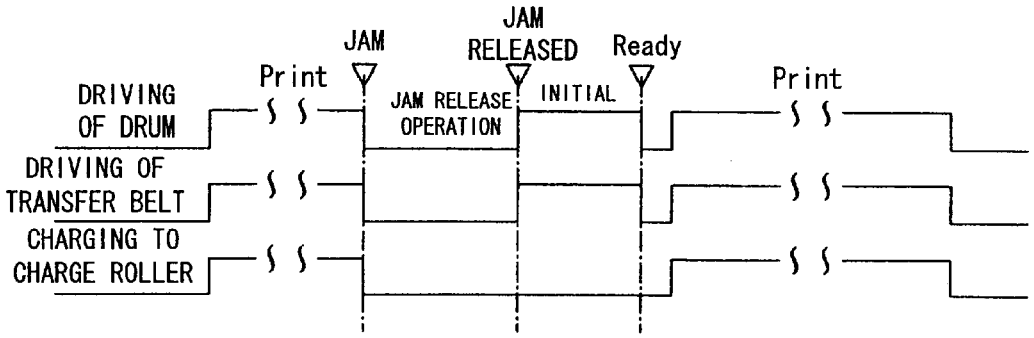
FIG. 6A is a time chart showing a conventional printer control.
Figure 6B:
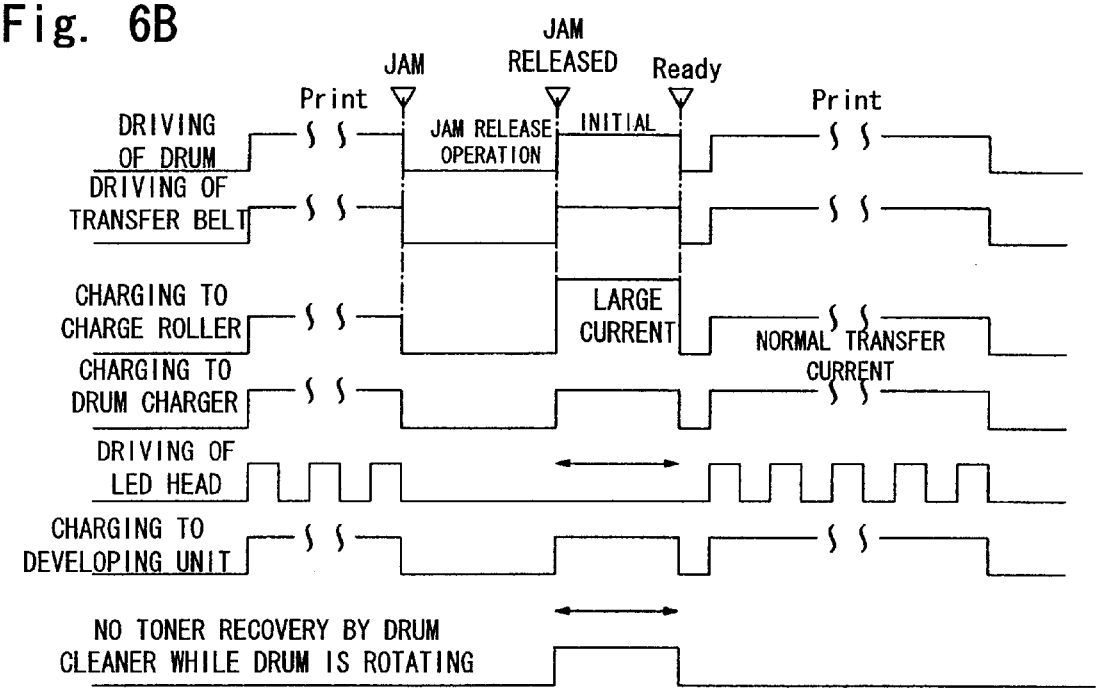
FIG. 6B is a time chart showing a printer control according to the preferred embodiment of the present invention.
Figure 7:
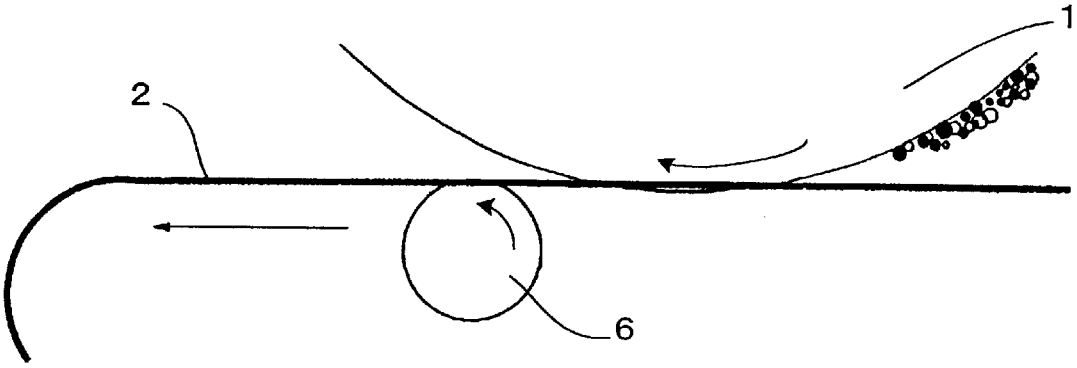
Fig. 7 PRIOR ART
Figure 8:
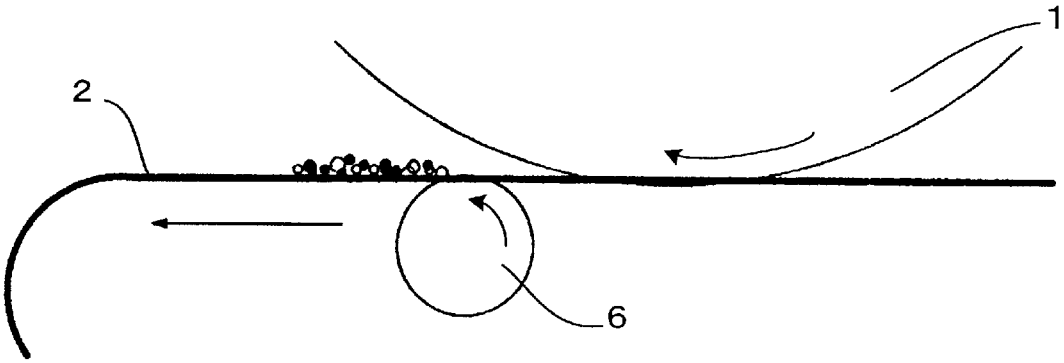
Fig. 8 PRIOR ART
FIG. 8 is an explanatory diagram showing a state wherein nonfixed toner is transferred from a photosensitive drum onto a transfer belt in a conventional image forming apparatus.

FIG. 6A is a time chart showing a conventional printer control, while FIG. 6B is a time chart showing the printer control in this embodiment.

In the conventional printer control shown in FIG. 6A, the charge roller 6 is charged only during a normal printing operation, and thus not charged during an initial operation upon restating the printer.

On the other hand, in this embodiment, as described above and as shown in FIG. 6B, the control box 50 executes the initial control upon restarting the printer to feed the current (450 $\mu$A or greater), which is greater than the transfer current required upon printing, to the charge roller 6 thereby to transfer the nonfixed toner with the paper powder on the photosensitive drum 1 onto the transfer belt 2 and then to remove the transferred toner with the paper powder by means of the belt cleaner 3. Further, the control box 50 controls the current control board 20 to charge the drum charger 8 and the developing roller 94, while prohibits formation of a latent image by the LED head 7.

Thus, as described above, according to this embodiment, the nonfixed toner with the paper powder on the photosensitive drum 1 is almost fully transferred onto the transfer belt 2 and then removed by the belt cleaner 3. Therefore, recycling of the toner mixed with the paper powder can be effectively prevented. Further, abrasion of the blade 101 of the drum cleaner 100 upon restarting the printer can be effectively prevented. In addition, the control is further performed so as not to generate a difference in potential between the photosensitive drum 1 charged by the drum charger 8 and the toner charged by the developing roller 94 of the developing unit 9, thus resulting in repulsion between the surface of the photosensitive drum 1 and the toner. Therefore, the toner is prevented from flowing out onto the photosensitive drum 1 due to the rotation of the photosensitive drum 1.

While the present invention has been described in terms of the preferred embodiment, the invention is not to be limited thereto, but can be embodied in various ways without departing from the principle of the invention as defined in the appended claims. For example, the LED head 7 may be replaced with another latent image forming unit using laser beam or the like.

What is claimed is:

1. An image forming apparatus comprising elements each having a charge feeding function, said elements including a transfer charger for charging a transfer member, an image holder, and a control means for, upon restarting of said image forming apparatus, executing an initial operation after an error in the operation of the image forming apparatus, to feed current to all of said elements, to cause said transfer member to abut upon the image holder for transferring nonfixed toner remaining on the image holder onto the transfer member, to drive said transfer member in a given direction, and to remove the transferred toner on said transfer member at a downstream side of a contact portion between said transfer member and said image holder in said given direction.

2. An image forming apparatus characterized by, upon restarting the image forming apparatus, feeding current to all elements each having a charge feeding function, said elements including a transfer charger for charging a transfer member, causing said transfer member to abut upon an image holder, driving said transfer member in a given direction, and cleaning said transfer member at a downstream side of a contact portion between said transfer member and said image holder in said given direction;

wherein said elements include an image holder charger for charging said image holder and a developing unit for developing a latent image on said image holder, and wherein the current is fed to said transfer charger, said image holder charger and said developing unit while prohibiting a latent image forming unit from forming a latent image on said image holder.

3. An image forming apparatus comprising:

an image holder on which an image is formed;

a transfer member for conveying a recording medium, said transfer member caused to abut upon said image holder so as to transfer the image formed on said image holder onto said recording medium;

a transfer charger for charging said transfer member;

a cleaner for cleaning said transfer member at a downstream side of a contact portion between said transfer member and said image holder in a driven direction of said transfer member;

a detecting means for detecting restart of the image forming apparatus; and a control means for, when said detecting means detects the restart of the image forming apparatus, executing an initial operation after an error in the operation of the image forming apparatus, to feed current to all elements each having a charge feeding function, said elements including said transfer charger, to cause said transfer member to abut upon said image holder for transferring nonfixed toner remaining on the image holder onto the transfer member, to drive said transfer member in said driven direction, and to cause said cleaner to remove the transferred toner on said transfer member at the downstream side of the contact portion between said transfer member and said image holder in said driven direction.

4. An image forming apparatus comprising:

an image holder on which an image is formed;

a transfer member for conveying a recording medium, said transfer member caused to abut upon said image holder so as to transfer the image formed on said image holder onto said recording medium;

a transfer charger for charging said transfer member;

a cleaner for cleaning said transfer member at a downstream side of a contact portion between said transfer member and said image holder in a driven direction of said transfer member;

a detecting means for detecting restart of the image forming apparatus; and a control means for executing a current feed control, wherein, when said detecting means detects the restart of the image forming apparatus, said control means feeds current to all elements each having a charge feeding function, said elements including said transfer charger, causes said transfer member to abut upon said image holder, and drives said transfer member in a given direction, and said cleaner cleans said transfer member at a downstream side of a contact portion between said transfer member and said image holder in said given direction;

wherein said elements include an image holder charger for charging said image holder and a developing unit for developing a latent image on said image holder, and wherein the current is fed to said transfer charger, said image holder charger and said developing unit while prohibiting a latent image forming unit from forming a latent image on said image holder.

5. An image forming apparatus characterized by, upon restarting the image forming apparatus, applying charge higher than charge required upon image formation to a transfer member, feeding current to an image holder charger for charging an image holder and a developing unit for developing a latent image on said image holder while prohibiting a latent image forming unit from forming a latent image on said image holder, causing said transfer member to abut upon said image holder, driving said transfer member in a given direction, and cleaning said transfer member at a downstream side of a contact portion between said transfer member and said image holder in said given direction.

6. The image forming apparatus according to claim 5, wherein when applying the charge to said transfer member, current of 450 $\mu$A or greater is fed to a transfer charger which charges said transfer member.

7. An image forming apparatus characterized by, upon restarting the image forming apparatus, feeding current to: a transfer charger for charging a transfer member, an image holder charger for charging an image holder, and a developing unit for developing a latent image on said image holder while prohibiting a latent image forming unit from forming a latent image on said image holder; causing said transfer member to abut upon said image holder; driving said transfer member in a given direction; and cleaning said transfer member at a downstream side of a contact portion between said transfer member and said image holder in said given direction.

* * * * *